United States Patent [19]

Ekbom

[11] Patent Number: 5,069,866

[45] Date of Patent: Dec. 3, 1991

[54] METHOD FOR MANUFACTURING A COMPOUND PIPE

[75] Inventor: Ragnar Ekbom, Finspång, Sweden

[73] Assignee: ABB Stal AB, Finspång, Sweden

[21] Appl. No.: 531,259

[22] Filed: May 31, 1990

[30] Foreign Application Priority Data

Jun. 1, 1989 [SE] Sweden ..... 8901984

[51] Int. Cl.[5] ..... B22F 7/00

[52] U.S. Cl. ..... 419/6; 419/19; 419/28; 419/49; 419/39; 419/54; 419/55

[58] Field of Search ..... 419/6, 19, 49, 28, 29, 419/54, 55

[56] References Cited

U.S. PATENT DOCUMENTS

| | | | |
|---|---|---|---|
| 3,780,418 | 12/1973 | Hurst | 419/6 |
| 4,050,143 | 9/1977 | Aslund | 75/214 |
| 4,143,208 | 3/1979 | Aslund | 428/558 |
| 4,150,196 | 4/1979 | Aslund | 428/558 |
| 4,364,162 | 12/1982 | Nilsson et al. | 419/26 |
| 4,373,012 | 2/1983 | Aslund et al. | 428/558 |
| 4,401,723 | 8/1983 | Aslund et al. | 428/554 |
| 4,486,385 | 12/1984 | Aslund | 419/48 |
| 4,602,952 | 7/1986 | Greene et al. | 419/6 |
| 4,640,815 | 2/1987 | Brosius et al. | 419/8 |
| 4,748,059 | 5/1988 | Brosius et al. | 428/35 |
| 4,935,198 | 6/1990 | Tornberg | 419/8 |

FOREIGN PATENT DOCUMENTS

| | | |
|---|---|---|
| 974098 | 9/1975 | Canada . |
| 3009882 | 9/1981 | Fed. Rep. of Germany . |
| 441337 | 9/1985 | Sweden . |

*Primary Examiner*—Stephen J. Lechert, Jr.
*Attorney, Agent, or Firm*—Leydig, Voit & Mayer

[57] ABSTRACT

A method of preparing a compound pipe, the wall of which comprises an inner layer of a first material and an outer layer of a second material. Powders of the two materials are isostatically hot pressed to form a cylindrical tubular blank in which the first material forms an inner layer and the second material forms an outer layer, the blank after heating to a suitable temperature being extruded over a mandrel.

6 Claims, 1 Drawing Sheet

METHOD FOR MANUFACTURING A COMPOUND PIPE

The invention relates to a method for manufacturing a compound pipe the wall of which comprises an inner layer of a first material and an outer layer of a second material.

In furnaces for pressurized fluidized bed combustion (PFBC), water pipes for generating steam or hot water are provided in the bed. These pipes are exposed to great wear (erosion) due to the fact that during the operation of the furnace the pipes are continuously blasted with the particulate material forming the bed. The pipes which are under high pressure must be made of a pressure vessel material, i.e. a material having great toughness, and such material is not at the same time a wear resistant material. Therefore, it is customary to provide on the pipes a wear resistant (brittle) surface layer consisting of a metal or metal alloy other than that from which the pipes are made, or of a metal oxide, and according to known technique this layer is sprayed onto the pipes consisting of pressure vessel material.

The purpose of the invention is to provide the wear layer on the outside of the pipes or on the inside thereof already at the manufacture of the pipes. There is a demand for such pipes also for transport of bed material or ash between different fluidized beds or between a bed and a receiving vessel for bed material or ash. It is the intention to provide by the invention a uniform layer of the wear material, which is integrated with the pressure vessel material such that a long life will be imparted to the pipes.

According to the invention said purpose is achieved by the method referred to above having obtained the features of claim 1.

Figure 1:
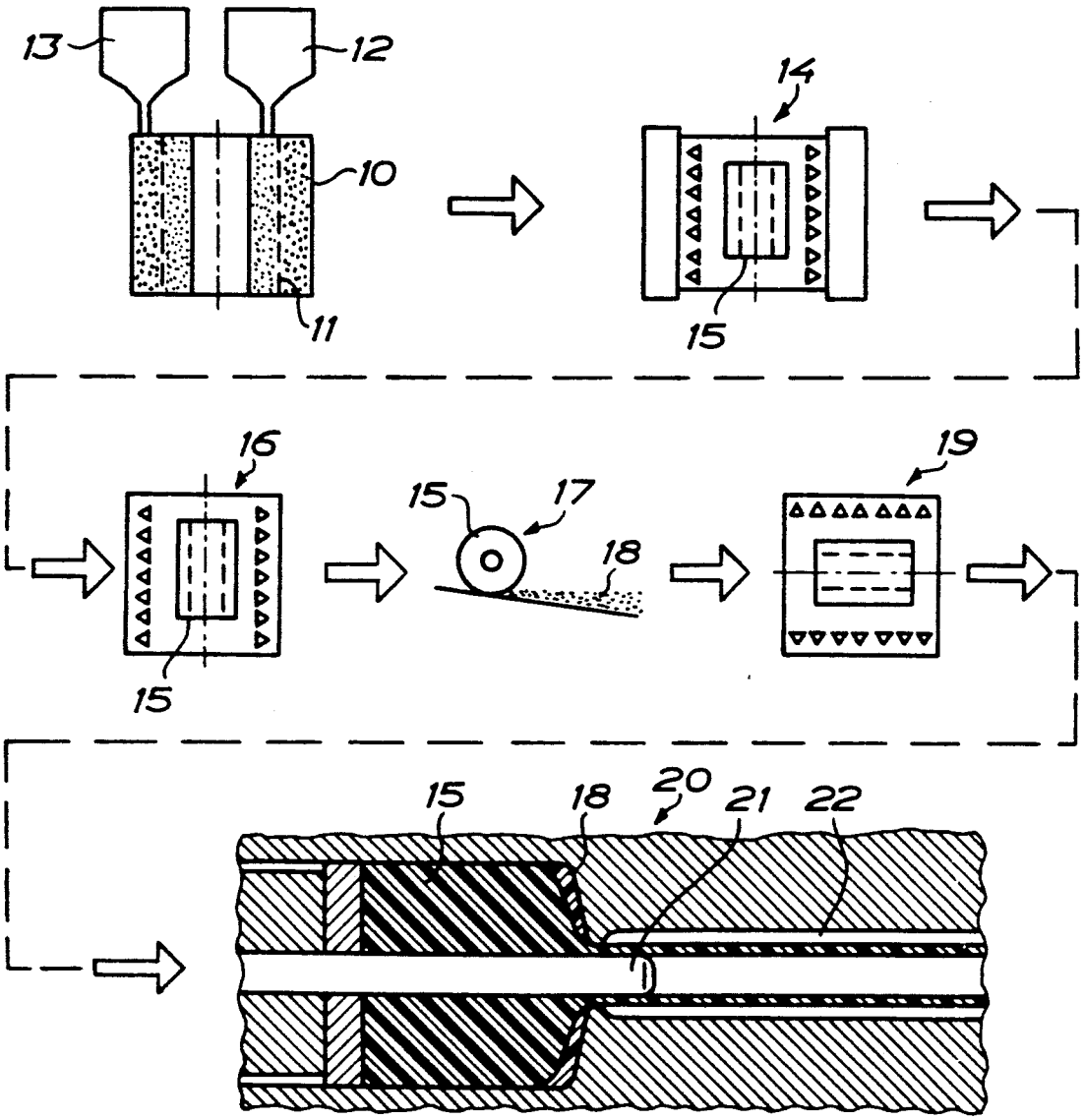
Figure 2:
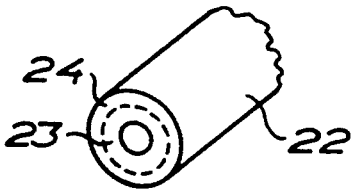

In order to explain the invention in more detail reference is made to the accompanying drawing in which FIG. 1 is a flow chart for one embodiment of the method of the invention, and FIG. 2 is a fragmentary perspective view of a compound pipe produced by the method of the invention.

A casing 10 for isostatic hot pressing, forming an annular cavity which is divided by means of a partition 11 into two co-axial compartments, one inner compartment and one outer compartment, the inner compartment is filled with a first powder 12 and the outer compartment is filled with a second powder 13. The powder 12 can consist of a pressure vessel material, for example an austenic stainless steel or a nickel based alloy, the powder 13 then consisting of a metal or metal alloy which has distinguished wear resistance, for example the material described in SE-C-8500773-0. The two materials can also be reversed in manufacturing a transport pipe of the kind referred to above. When choosing a tube material the yield strength of the materials should be taken into account as will be discussed in more detail below.

When the casing has been filled and evacuated, isostatic hot pressing takes place at the stage indicated at 14 in the drawing, and it is obtained by this step a tubular blank 15, the wall of which comprises an inner layer of pressure vessel material and an outer layer of wear resistant material. In the following stage 16 this blank is preheated in an oven in order that the blank then in stage 17 shall be coated with glass powder 18 on the outside thereof and the blank at this coating shall have such a high temperature that the glass powder will melt and form a glass layer on the outside of the blank.

A following stage 19 comprises induction heating of the blank to a suitable temperature for extrusion of the blank and this temperature should be of the order of 1000°-1100° C. In this connection it should be mentioned that the two materials should be chosen such that the materials at the necessary extrusion temperature have substantially the same yield strength.

When the blank thus prepared has reached the necessary temperature it is supplied to an extruder 20 to be extruded over a mandrel 21 providing a compound pipe 22, FIG. 2, having an inner layer 23 of pressure vessel material and an outer layer 24 of resistant material. During the extrusion the glass layer applied functions as a lubricant.

What is claimed:

1. Method of preparing a compound pipe, the wall of which comprises an inner layer of a first material and an outer layer of a second material, comprising the steps of hot pressing isostatically powders of the two materials to form a cylindrical tubular blank wherein the first material forms an inner layer and the second material forms an outer layer, heating the blank to a suitable temperature, and extruding the heated blank over a mandrel.

2. The method according to claim 1 wherein the two materials are chosen such that they have at the extrusion temperature substantially the same yield strength.

3. The method according to claim 1 wherein the blank is heated to a temperature between 1000°-1100° C.

4. The method according to claim 1 wherein the blank is heated by induction heating.

5. The method according to claim 1 wherein the blank after preheating is coated with a glass layer at the outside thereof before being heated to the extrusion temperature.

6. The method according to claim 1 wherein one of the materials consists of a pressure vessel material and the other one consists of a wear resistant material.

* * * * *